United States Patent [19]

Talavera

[11] Patent Number: 4,914,922

[45] Date of Patent: Apr. 10, 1990

[54] METHOD OF TEMPERATURE TREATING GRANULAR MATERIAL

[76] Inventor: Dino Talavera, P.O. Box 871690, Wasilla, Ak. 99687

[21] Appl. No.: 313,016

[22] Filed: Feb. 21, 1989

[51] Int. Cl.[4] ..... F25D 13/06

[52] U.S. Cl. ..... 62/63; 62/57; 164/5

[58] Field of Search ..... 62/57, 63; 164/5

[56] References Cited

U.S. PATENT DOCUMENTS

| | | | |
|---|---|---|---|
| 2,188,798 | 1/1940 | Smith | 22/89 |
| 2,519,148 | 8/1950 | McShea | 257/6 |
| 2,585,739 | 2/1952 | Christian | 62/170 |
| 2,758,445 | 8/1956 | Saxe | 62/1 |
| 3,205,543 | 9/1965 | Morri et al. | 22/89 |
| 3,334,493 | 8/1967 | Dietert | 62/157 |
| 3,447,338 | 6/1969 | Smith, Jr. | 62/57 |
| 3,691,644 | 9/1972 | Schnitzer | 62/57 |
| 4,100,760 | 7/1978 | Cheney | 62/57 |
| 4,150,704 | 4/1979 | Hoult | 164/12 |

FOREIGN PATENT DOCUMENTS

| | | | |
|---|---|---|---|
| 2138531 | 2/1973 | Fed. Rep. of Germany | 164/5 |
| 209743 | 12/1982 | Japan | 164/5 |

*Primary Examiner*—Ronald C. Capossela

*Attorney, Agent, or Firm*—Warren F. B. Lindsley

[57] ABSTRACT

A process for temperature treating a granular material such as sand by the use of ambient air moving through the material, as it drops under gravity from a screen, at a wind velocity high enough to invoke forced convection as an aid in accomplishing the temperature controlling function.

6 Claims, 1 Drawing Sheet

METHOD OF TEMPERATURE TREATING GRANULAR MATERIAL

BACKGROUND OF THE INVENTION

This invention relates to a process for preconditioning sand or a like material by altering its temperature and/or moisture content to maintain it in a granular form.

In an average winter, highway departments in the United States spread some ten million tons of salt to keep roads safe. The corrosive effects of the salt are well known but this objection has been dismissed with the argument that at $25.00 a ton for salt this method of road treatment is far cheaper than any alternative. However, the Environmental Protection Agency estimates that salt induced road damage and vehicle corrosion costs $3 billion a year.

While sand and gravel are good economical alternatives, one of the major problems in using these products is in keeping them from clumping or freezing together. When sand is wet or freezes together, it costs more to get it separated than the cost of the sand.

Currently, sand and gravel are kept free flowing during subzero temperatures by storing it in a warm building. Frozen sand and gravel must be screened and frequently mixed with salt to keep it useable.

Further, in moist climates it is necessary to reduce the moisture content of the sand to render it free flowing.

DESCRIPTION OF THE PRIOR ART

Although methods are known for temperature conditioning sand and other like material for building purposes, none are known which preserve the free flowing condition of this material in wet and sub freezing temperatures by freezing by forced convection the sand to aid in drying and freezing it before use.

U.S. Pat. No. 2,188,798 discloses a process for reconditioning foundry sand wherein the sand is carried through a horizontally inclined rotatable cylindrical shell in which the sand is mixed, aerated and then sprayed with water.

U.S. Pat. No. 2,519,148 relates to an apparatus for preconditioning sand by altering the temperature thereof for incorporation with other ingredients in a concrete mix.

U.S. Pat. No. 2,585,739 discloses the preparation of sand and gravel for use in the manufacture of cement. The sand and gravel pass through a heat exchanger which cools but does not freeze the sand.

U.S. Pat. No. 2,758,445 discloses a device for cooling and dewatering sand and aggregate wherein the material is washed, tumbled and commingled with chopped ice or sprayed with ice water.

U.S. Pat. No. 3,205,543 discloses a process and apparatus for cooling foundry sand on a vibratory conveyor as it comes from a mold without reduction of its moisture content.

U.S. Pat. No.3,334,493 discloses an apparatus for cooling granular material which spills from a conveyor belt into a compartment into which is blown cooling air.

U.S. Pat. No. 4,150,704 discloses a method of freezing sand in a mold that will be filled with molten metal.

SUMMARY OF THE INVENTION

In accordance with the invention claimed, a new and improved process is disclosed for using ambient temperature or artificially chilled air propelled at a high velocity to dry and/or freeze free flowing sand or other material in particulate form to preserve its free flowing characteristics in wet and/or sub freezing temperatures.

It is, therefore, one object of this invention to provide a new and improved process for maintaining free flowing sand or other like material in particulate form.

Another object of this invention is to provide a new and improved process that uses a forced convection process to aid in freezing free flowing sand or other like materials.

A further object of this invention is to provide a new and improved method for freezing particulates to maintain their free flowing condition in sub freezing temperatures.

A still further object of this invention is to provide a method of maintaining sand or gravel in a loose or granular state by means of a forced draft of air at sub freezing temperatures.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
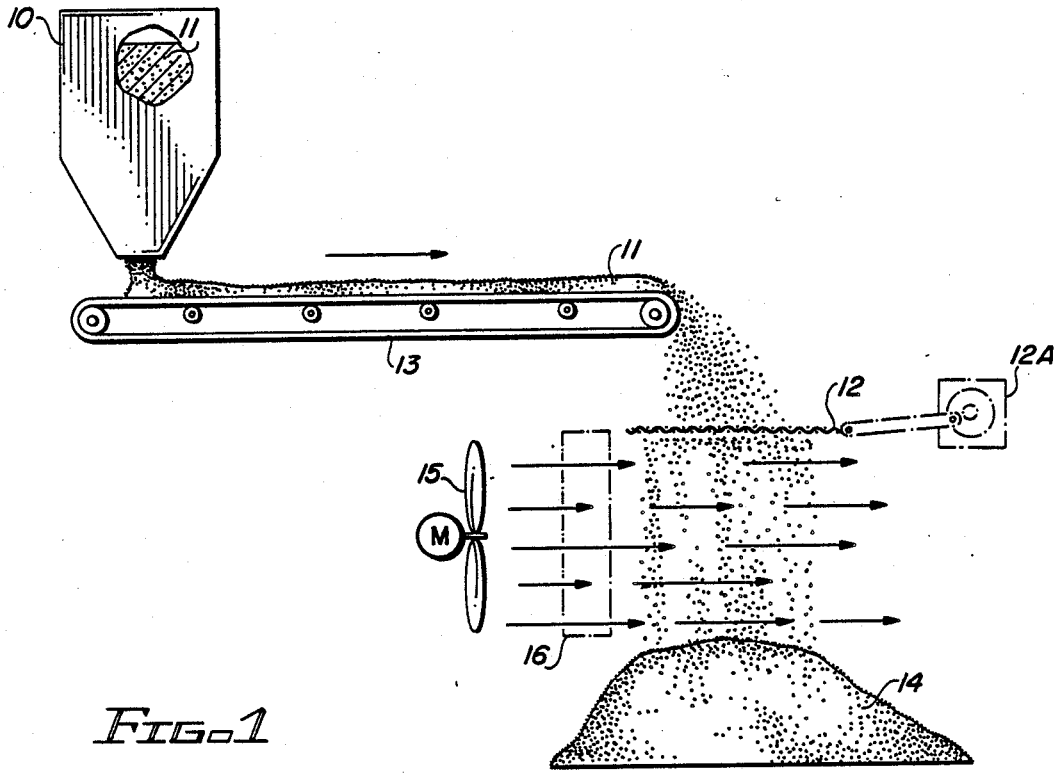
FIG. 1 is a diagrammatic illustration of the process steps utilized in practicing the invention.

Referring more particularly to the drawing by characters of reference, FIG. 1 illustrates a hopper 10 for storing sand 11 or other like material which is intended to be preconditioned by altering its temperature and moisture content. The sand is delivered continuously or intermittently from the hopper to a screening means 12 by a trommel or conveyor belt 13.

The sand or other like material that passes through the screening means 12 during actuation of its vibratory means 12A is dropped under the action of gravity to a stock pile 14 or a further conveyor means during which the sand particles or other particulates are dried and/or frozen in their individual particle state by means of a forced draft of air which may be at sub freezing temperatures.

This process using air which may be at ambient freezing temperatures is propelled at a high velocity by a wind source 15 through the freely flowing sand or other material in particulate form dropped from screening means 12. If desired, this material may be artificially chilled by a refrigeration means 16 with both processes utilizing a forced convection process to aid in freezing the material. The dry and/or frozen particles maintain this form even though the material (i.e., particles) are stacked and stored for future use.

One example of a suitable wind source for use in this process is the seven foot propeller rotated at 1800 revolutions per minute (RPM) in ambient freezing temperatures or ambient air artificially chilled to a temperature below 32 degrees fahrenheit.

This type of wind source can handle up to 24 cubic yards per hour.

Figure 2:
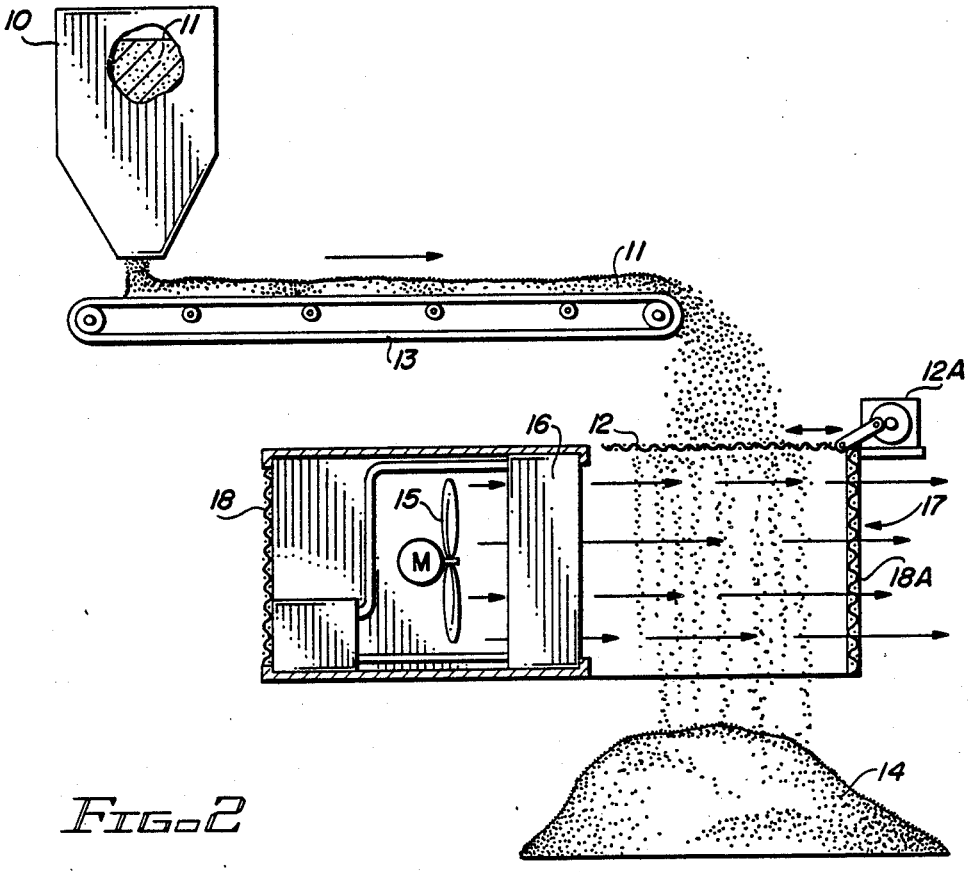
FIG. 2 is a modification of the apparatus shown in FIG. 1 for practicing the invention.

FIG. 2 illustrates a modification of the apparatus shown in FIG. 1 for practicing the invention wherein screening means 12 discharges the screened material into an open ended cylinder or housing 18 which confines the material as it free falls from screening means 12 to a stock pile 14 or suitable conveyor. The wind source 15 mounted within cylinder 18 is utilized to drive ambient air which may be at a freezing temperature or air artificially chilled through the apertured surfaces 18A of cylinder 18 to dry and/or dry and freeze the individual particles of the material prior to stock piling for use.

It should be noted that the housing of the blower confines and directs the air flow through the apertured or screen walls of cylinder 18, thereby confining the sand as it drops under the action of gravity while being dried and/or frozen.

It should be noted that the free falling condition of the sand aids in keeping it separated prior to drying and freezing. Further, a material rotary agitator of the type shown in U.S. Pat. No. 2,758,445 which is embodied herein by reference may be used in hopper 10 to aid in keeping the sand and like material in particulate form.

Although but two embodiments of the invention have been shown and described, it will be apparent to those skilled in the art that various changes and modifications may be made therein without departing from the spirit of the invention or from the scope of the appended claims.

What is claimed is:

1. A process for preconditioning a granular material by altering its temperature to maintain it in a granular form for use in sub freezing temperature comprising the steps of:

screening the material, causing the screened granular material to drop through the air under the action of gravity, and freezing the granules of the material as they drop through the air by the movement of air therethrough at a velocity high enough to invoke forced convection as an aid in accomplishing the freezing function, said freezing being accomplished by a fan flowing ambient freezing air laterally through the screened granular material as it drops through the air.

2. The process set forth in claim 2 wherein:

the freezing is accomplished by a wind source of ambient air artificially cooled blown laterally through the screened granular material as it drops through the air.

3. A process for freezing granules of sand to maintain their free flowing condition in sub freezing temperatures, the steps comprising:

moving a stream of sand by a conveyor from a source of sand over a screening means, screening the sand, causing the screened sand to drop through the air to a collection area, and freezing the granules of the screened sand as they drop from the screen by a wind source which forces ambient freezing air laterally through the granules of screened sand at a velocity high enough to utilize forced convection as an aid in freezing each granule of sand.

4. The process set forth in claim 2 wherein:

the ambient freezing air is forced through the granules of sand by a fan.

5. The process set forth in claim 2 wherein:

the ambient freezing air is forced through the granules of sand by a blower means employing a refrigerating means for cooling the air.

6. The process set forth in claim 3 wherein:

the screened sand is dropped through a screened area, and the wind source comprises a housing which controls the flow of ambient air through the sand in the screened area.

* * * * *

UNITED STATES PATENT AND TRADEMARK OFFICE

CERTIFICATE OF CORRECTION

PATENT NO. : 4,914,922

DATED : April 10, 1990

INVENTOR(S) : Dino Talavera

It is certified that error appears in the above-identified patent and that said Letters Patent is hereby corrected as shown below:

Col. 4, claim 1, line 3, cancel "flowing" and substitute --blowing--.

Col. 4, claim 2, line 1, cancel "2" and substitute --1--.

Col. 4, claim 4, line 1, cancel "2" and substitute --3--.

Col. 4, claim 5, line 1, cancel "2" and substitute --3--.

Signed and Sealed this

Eighteenth Day of June, 1991

*Attest:*

*Attesting Officer*

HARRY F. MANBECK, JR.

*Commissioner of Patents and Trademarks*